US008021246B2

(12) United States Patent
Llewellyn et al.

(10) Patent No.: US 8,021,246 B2
(45) Date of Patent: Sep. 20, 2011

(54) IRON GOLF CLUB HEADS AND GOLF CLUB SETS WITH VARIABLE WEIGHT DISTRIBUTION

(75) Inventors: David Llewellyn, Duluth, GA (US); Tetsuya Kanayama, Osaka (JP); Isamu Toshinari, Osaka (JP); Kazuhiro Doi, Gifu-pref (JP); Tomoaki Aoki, Osaka (JP)

(73) Assignee: Mizuno USA, Inc., Norcross, GA (US)

( * ) Notice: Subject to any disclaimer, the term of this patent is extended or adjusted under 35 U.S.C. 154(b) by 0 days.

(21) Appl. No.: 12/492,784

(22) Filed: Jun. 26, 2009

(65) Prior Publication Data

US 2010/0160067 A1 Jun. 24, 2010

Related U.S. Application Data

(63) Continuation of application No. 29/330,012, filed on Dec. 24, 2008, now Pat. No. Des. 600,765, and a continuation of application No. 29/330,013, filed on Dec. 24, 2008, now Pat. No. Des. 600,766, and a continuation of application No. 29/336,410, filed on May 4, 2009, now Pat. No. Des. 611,554.

(51) Int. Cl.
*A63B 53/04* (2006.01)

(52) U.S. Cl. ..... 473/332; 473/350

(58) Field of Classification Search ..... 473/332, 473/350, 290–291
See application file for complete search history.

(56) References Cited

U.S. PATENT DOCUMENTS

| | | | | | |
|---|---|---|---|---|---|
| 3,059,926 | A | * | 10/1962 | Johnstone | 473/291 |
| 5,014,993 | A | * | 5/1991 | Antonious | 473/350 |
| 5,295,686 | A | * | 3/1994 | Lundberg | 473/291 |
| D359,540 | S | | 6/1995 | Allen | |
| 5,447,307 | A | * | 9/1995 | Antonious | 473/350 |
| 5,547,426 | A | * | 8/1996 | Wood | 473/290 |
| 5,549,297 | A | * | 8/1996 | Mahaffey | 473/290 |
| 5,649,872 | A | * | 7/1997 | Antonious | 473/332 |
| D382,616 | S | | 8/1997 | Heffley | |
| 5,674,133 | A | * | 10/1997 | Chang et al. | 473/291 |
| 5,722,900 | A | * | 3/1998 | Sung | 473/291 |
| D404,780 | S | | 1/1999 | Long | |
| D454,606 | S | * | 3/2002 | Helmstetter et al. | D21/747 |
| D456,056 | S | | 4/2002 | Bakke | |
| D466,961 | S | | 12/2002 | Nagai et al. | |
| D476,708 | S | | 7/2003 | Wahl et al. | |
| D489,106 | S | | 4/2004 | Wahl et al. | |
| D497,963 | S | | 11/2004 | Toulon et al. | |
| D499,155 | S | * | 11/2004 | Imamoto | D21/747 |
| D502,751 | S | * | 3/2005 | Lukasiewicz | D21/759 |
| D512,756 | S | * | 12/2005 | Kawami | D21/747 |
| D516,649 | S | * | 3/2006 | Imamoto | D21/747 |
| D539,863 | S | | 4/2007 | Nunez et al. | |
| D549,295 | S | | 8/2007 | Nagai et al. | |

(Continued)

*Primary Examiner* — Stephen L. Blau
(74) *Attorney, Agent, or Firm* — Troutman Sanders LLP; James E. Schutz; Jihan A. R. Jenkins

(57) ABSTRACT

Described herein are iron golf club heads and sets of iron golf clubs that have variable weight distribution. Each iron golf club head has a cavity and a y-shaped cavity pad disposed on at least a portion of a back wall of the cavity. The y-shaped cavity pad provide reduced vibrations within the cavity when the iron golf club head strikes a golf ball. The y-shaped cavity pad also provides an enlarged sweet spot to provide increased forgiveness for off-center hits. Other aspects, features, and embodiments are also claimed and described.

6 Claims, 5 Drawing Sheets

U.S. PATENT DOCUMENTS

| | | | | | |
|---|---|---|---|---|---|
| D550,316 | S | | 9/2007 | Nagai et al. | |
| D553,704 | S | | 10/2007 | Nunez et al. | |
| D556,279 | S | | 11/2007 | Lorentzen et al. | |
| D566,803 | S | | 4/2008 | Foster et al. | |
| D591,373 | S | | 4/2009 | Foster et al. | |
| D591,808 | S | | 5/2009 | Clausen et al. | |
| D591,819 | S | * | 5/2009 | Bosilkovski et al. | D21/759 |
| D596,684 | S | | 7/2009 | Sutovsky et al. | |
| D597,157 | S | | 7/2009 | Wallin et al. | |
| D598,061 | S | | 8/2009 | Barez et al. | |
| D600,765 | S | | 9/2009 | Llewellyn et al. | |
| D600,766 | S | | 9/2009 | Llewellyn et al. | |
| 7,722,479 | B2 | * | 5/2010 | Soracco | 473/350 |
| 7,833,110 | B2 | * | 11/2010 | Nakamura | 473/332 |
| 7,867,105 | B2 | * | 1/2011 | Moon | 473/314 |
| 2003/0199331 | A1 | * | 10/2003 | Stites, III | 473/290 |
| 2005/0239572 | A1 | * | 10/2005 | Roach et al. | 473/332 |
| 2009/0298615 | A1 | * | 12/2009 | Moon | 473/350 |
| 2010/0285899 | A1 | * | 11/2010 | Soracco | 473/332 |

* cited by examiner

IRON GOLF CLUB HEADS AND GOLF CLUB SETS WITH VARIABLE WEIGHT DISTRIBUTION

CROSS-REFERENCE TO RELATED APPLICATIONS & PRIORITY CLAIMS

This application is a continuation of, and claims priority to: U.S. Design patent application Ser. Nos. 29/330,012 and 29/330,013, filed on 24 Dec. 2008; and U.S. Design patent application Ser. No. 29/336,410, filed on 4 May 2009, all of said applications are incorporated herein by reference in their entireties as if fully set forth below.

TECHNICAL FIELD

The various embodiments of the present invention relate generally to iron golf club heads and, more particularly, to cavity-back iron golf club heads with y-shaped cavity pads, which result in both reduced vibrations within the cavity and an enlarged sweet spot to provide increased forgiveness on off-center hits.

BACKGROUND

Perimeter weighted iron golf club heads have become increasingly popular with golfers since they were first introduced in the 1980's. The cavity-back iron golf club head moved most of the weight that was located behind the face of the golf club out to the perimeter of the golf club, which enlarged the "sweet spot" of the golf club and made the golf club more forgiving on "off-center" hits as compared to the traditional irons. Also, by moving the weight towards the perimeter, the thickness of the faces of the cavity back iron golf clubs became uniform and relatively thin. This resulted in a significant increase in the amount of carry in the case of off-center hits (i.e., where the golf ball is struck at a location other than the sweet spot) especially toward the toe area of the face. Unfortunately, this also resulted in a reduction in solid feel.

Another problem with traditional cavity-back iron golf clubs is that little of the weight is offset from the face portion. As a result, the center of gravity (COG) depth is not very great. One attempt to overcome this problem was to "offset" the clubface from the shaft portion, thereby placing the majority of the weight behind the shaft axis. Although the offset of the golf club increased the COG depth, it made the club unattractive to the golfer, especially those golfers who preferred the look of the traditional irons.

Therefore, there is a continuing need for an iron golf club head that has the improved playability properties of cavity-back golf clubs, while retaining the look and characteristics of traditional golf clubs. In particular, there is a need for an iron golf club head that provides an increased center of gravity depth, and a large sweet spot. It is to the provision of such iron golf club heads, and golf club sets made therefrom, that the various embodiments of the present invention are directed.

BRIEF SUMMARY OF EXEMPLARY EMBODIMENTS

The various embodiments of the present invention meet the needs described above by providing iron golf club heads and golf club sets, as well as methods of making and using the iron golf club heads and golf club sets. Generally described, an iron golf club head includes a cavity, a face portion for striking a golf ball, a heel portion, a toe portion, a top portion, and a sole portion. The iron golf club head also includes a y-shaped cavity pad disposed on at least a portion of the back wall of the cavity. The iron golf club head can also include an optional weight disposed on at least a portion of the back wall of the cavity. The optional weight can extend upward from the sole portion such that the y-shaped cavity pad extends between the top of the weight and the top of the cavity.

The iron golf club head can also have an extended rear wall portion that is offset from the back wall of the cavity and that extends upward from the sole portion. In some cases, the extended rear wall portion is triangular in shape. In some situations, the location of a maximum height of the triangular extended rear wall portion can be vertically aligned with a location of a maximum thickness of the sole portion. This location (i.e., the location of the maximum height of the triangular extended rear wall portion and the location of the maximum thickness of the sole portion) is generally much closer to the toe portion than the heel portion.

The iron golf club head can also include an optional groove within the sole portion. The optional groove can extend between the back wall of the cavity and the extended rear wall portion.

Another example of an iron golf club head has a cavity, a face portion, a heel portion, a toe portion, a top portion and a sole portion, too. This iron golf club head also includes a y-shaped cavity pad disposed on at least a portion of the back wall of the cavity, an extended rear wall portion offset from the back wall of the cavity and extending upward from the sole portion, and a groove within the sole portion extending between the back wall of the cavity and the extended rear wall portion, such that the location of a maximum height of the extended rear wall portion is vertically aligned with the location of a maximum thickness of the sole portion. This iron golf club head can also have the optional weight disposed on at least a portion of the back wall of the cavity and extending upward from the sole portion, such that the y-shaped cavity pad extends between the top of the weight and a top of the cavity.

Other embodiments of the present invention are directed to sets of iron golf clubs. These sets can include at least one long iron golf club, at least one middle iron golf club, and at least one short iron golf club. Each of the at least one long iron golf club, at least one middle iron golf club, and at least one short iron golf club within the set can have a head that includes a cavity, a face portion, a heel portion, a toe portion, a top portion, and a sole portion. Each head of the golf clubs within the set can also include a y-shaped cavity pad disposed on at least a portion of the back wall of the cavity. The head of each of the golf clubs within the set can also include a weight disposed on at least a portion of the back wall of the cavity and extending upward from the sole portion, such that the y-shaped cavity pad extends between the top of the weight and a top of the cavity.

The head of each of the golf clubs within the set can also have an extended rear wall portion offset from the back wall of the cavity and extending upward from the sole portion. In some cases, the extended rear wall portion of the head of each of the golf clubs within the set is triangular in shape. The location of a maximum height of the extended rear wall portion can be vertically aligned with a location of a maximum thickness of the sole portion of the head of each golf club within the set. This location can be much closer to the toe portion than the heel portion.

In some situations, the head of each of the at least one long iron golf club and at least one middle iron golf club has a groove within the sole portion extending between the back wall of the cavity and the extended rear wall portion. It is also possible for the head of each of the at least one short iron golf club to have the groove as well.

Other aspects and features of embodiments of the present invention will become apparent to those of ordinary skill in the art, upon reviewing the following detailed description in conjunction with the accompanying figures.

DETAILED DESCRIPTION OF EXEMPLARY & ALTERNATIVE EMBODIMENTS

Figure 1:
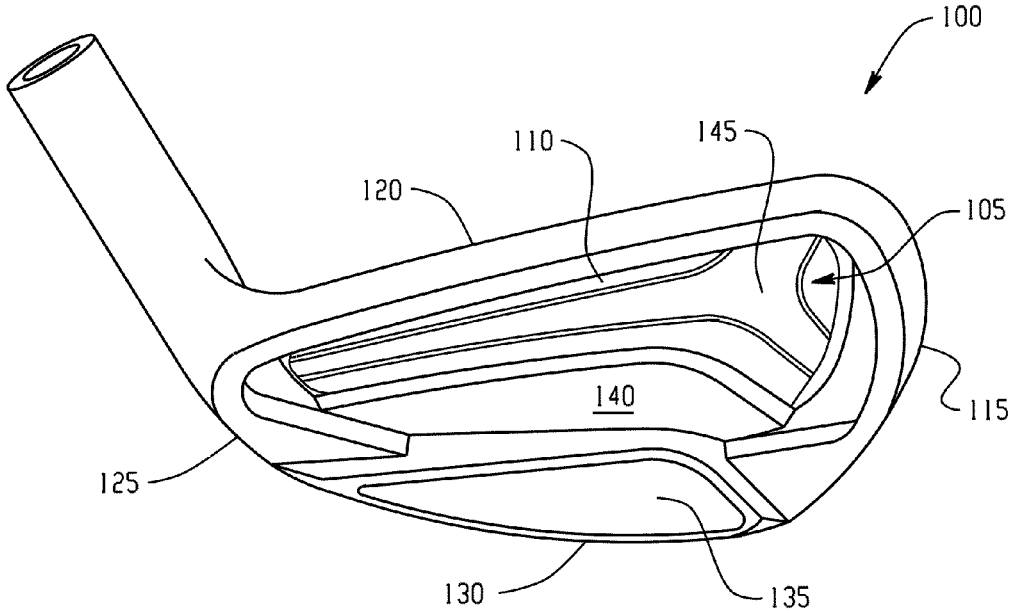
FIG. 1 is an illustration of a bird's eye view of an iron golf club head in accordance with some embodiments of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, and "top," "bottom," and the like do not denote any order, quantity, or importance, but rather are used to distinguish one element from another. Further, the terms "a", "an", and "the" do not denote a limitation of quantity, but rather denote the presence of "at least one" of the referenced item.

FIG. 1 is a diagram illustrating a bird's eye view of an iron golf club head 100 in accordance with some embodiments of the present invention. The iron golf club head 100 includes a cavity 105, which contains a back wall 110, and is surrounded by a toe portion 115, a top portion 120, a heel portion 125 and a sole portion 130. The iron golf club head 100 also includes a face portion (not shown), which is used for striking a golf ball.

The back wall 110 of the cavity 105 can include a weight 140 disposed thereon, which can be positioned toward the sole portion 130 within the cavity 110. The weight 140 can have a specific length, which is less than or equal to the length of the cavity 105, and may extend along an axis projecting from the toe portion 115 to the heel portion 125. For example, in some embodiments, the length of the weight 140 can be approximately 60 millimeters. The weight 140 is generally positioned directly behind the ball-hitting portion of the face portion to provide a high coefficient of restitution (COR), which is typically greater than 0.8. This concentration of mass increases the so-called "sweet spot" on the face portion, thereby improving the "feel" of the golf club for the average golfer. The weight 140 can adopt a variety of geometric shapes, including that of a rhombus (as seen in FIG. 1), trapezoid, rectangle, triangle, circle, or the like.

In some instances, it is desirable to have the thickness of the weight 140 be tapered along its length from the toe portion 115 to the heel portion 125, such that the weight 140 increases in thickness at it progresses from the heel portion 125 towards the toe portion 115. By way of example, the thickness of the tapered weight 140 can be approximately three (3) millimeters toward the toe portion 115, while it can be approximately one (1) to two (2) millimeters toward the heel portion 125. The taper allows more mass to be placed toward the toe portion 115 of the iron golf club head 100. This feature (i.e., the additional mass towards the toe portion 115) allows for "off-center" hits toward the toe of the face portion to feel more solid.

The back portion 110 of the iron golf club head 100 also contains a y-shaped cavity pad 145, which extends between the top of the tapered weight 140 and the top of the cavity 105. The y-shaped cavity pad 145 may have a uniform thickness across its length, which is typically less than the thickness of the tapered weight 140. For example, the thickness of the y-shaped cavity pad 145 can be approximately one (1) millimeter. The y-shaped cavity pad 145 reinforces the upper portion of the cavity 105. The inclusion of the y-shaped cavity pad 145 provides an advantage over traditional cavity backed iron golf clubs. In traditional cavity-backed iron golf clubs, since the majority of the weight is moved toward the perimeter of the golf club, the cavity may resonate, or vibrate, especially on off-center hits, making the club feel unstable. The y-shaped cavity pad 145 of the present iron golf club head 100 provides a reinforcement of the upper portion of the cavity 105 and therefore, reduces unwanted vibrations within the cavity 105 producing a solid feel back to the golfer when striking a golf ball, especially on off-center hits. Furthermore, the y-shaped cavity pad 145 effectively extends and expands the sweet spot of the club head 100 out towards the toe portion 115 to provide increased forgiveness on off-center hits.

The iron golf club head 100 may also include an extended rear wall portion 135, which is offset from the back wall 110 of the cavity 105. The extended rear wall portion 135 also extends upward from the sole portion 130. The rearmost point of the extended rear wall portion 135 may be offset from the back wall 110 between approximately eight (8) and fifteen (15) millimeters. This allows more of the weight to be positioned farther back from the face portion and closer to the sole portion 130, which in turn increases the center of gravity (COG) depth of the golf club head 100.

Additionally, the extended rear wall portion 135 has a predefined thickness, which may be tapered along its length from the toe portion 115 to the sole portion 125. In one embodiment, the extended rear wall portion 135 has a thickness of approximately eight to approximately fifteen millimeters toward the toe portion 115, and a thickness of approximately three (3) to approximately ten (10) millimeters toward the heel portion 125. The taper provides additional weight toward the toe portion 115 of the iron golf club 100 to provide further stability and promote a more solid feel to a golfer when the ball is struck off-center toward the toe of the face portion. The extended rear wall portion 135 has a height, which is tapered along its length from the toe portion 115 to the sole portion 125. In one embodiment, the extended rear wall portion 135 has a height of approximately 5 to approximately 25 millimeters, with the maximum height being toward the toe portion 115. The taper provides additional weight toward the toe portion 115 of the iron golf club 100 to provide further stability and promote a more solid feel to a golfer when the ball is struck off-center toward the toe of the face portion. Finally, the length of the extended rear wall portion 135 can range from approximately 40 millimeters to approximately 70 millimeters. The projected wall portion 135 is typically triangular in shape, with the base of rear wall portion 135 being the adjacent to the sole portion 130. Those skilled in the art will appreciate that the projected wall portion 135 may be in the form of other shapes, such as a trapezoid, a rectangle, a square, a circle, a semi-circle, and the like without departing from the scope of the invention.

Figure 2:
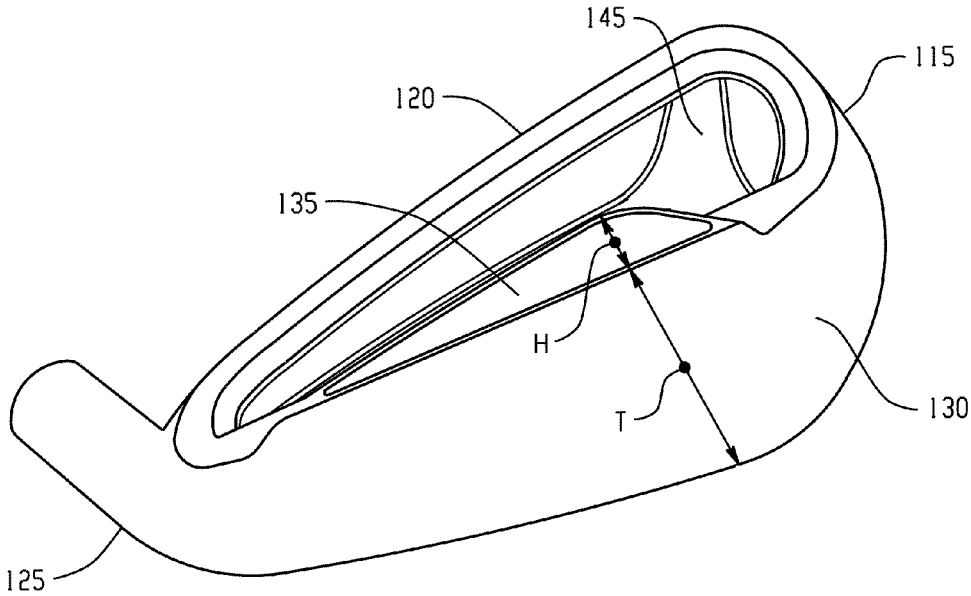
FIG. 2 is an illustration of a bottom perspective view of the iron golf club head of FIG. 1 in accordance with some embodiments of the present invention.

In an exemplary embodiment, shown in FIG. 2, the extended rear wall portion 135 has its maximum height, H, at a point that corresponds to the location where the sole portion 130 has its maximum thickness, T. That is, the peak point of the extended rear wall portion 135 is vertically aligned with the maximum thickness position of the sole portion 130. For example, the thickness of the sole portion 130 can by approximately 10 to approximately 25 millimeters at the heel portion 125, and approximately 15 to approximately 30 millimeters at T (where the height of the extended rear wall portion 135 is approximately 5 to approximately 25 millimeters). This feature provides an efficient COG depth, while keeping the overall weight of the extended rear wall portion 135 low. This feature also moves the COG away from the heel portion 125; and, in doing so, the moment of inertia (MOI) in the toe-heel direction is improved.

Figure 3:
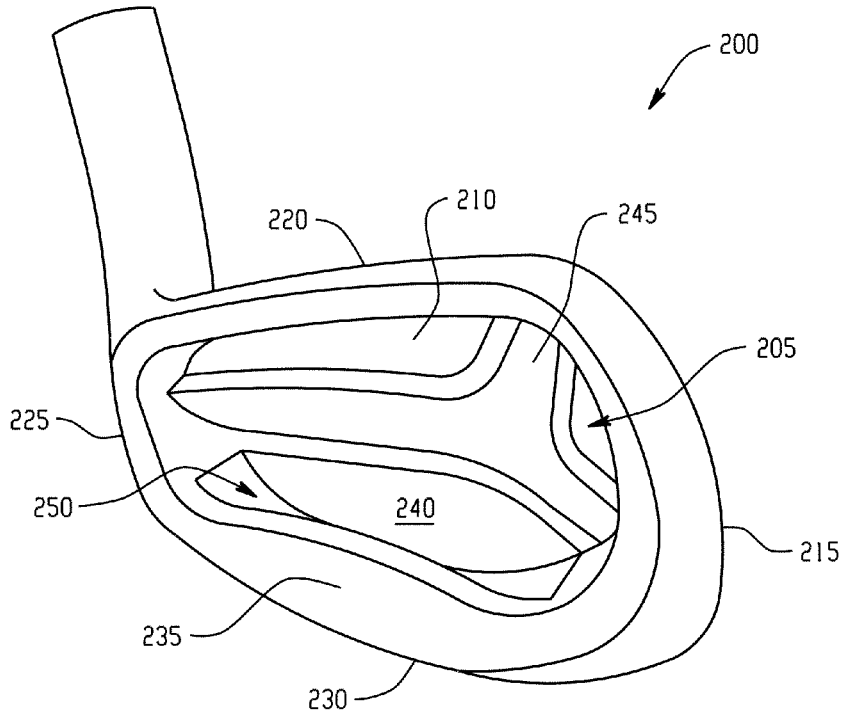
FIG. 3 is an illustration of a bird's eye view of another iron golf club head in accordance with some embodiments of the present invention.

FIG. 3 is a diagram illustrating a bird's eye view of another iron golf club head 200 in accordance with other embodiments of the present invention. The iron golf club head 200 includes a cavity 205, which contains a back wall 210, and is surrounded by a toe portion 215, a top portion 220, a heel portion 225 and a sole portion 230. The iron golf club head 200 also includes a face portion (not shown), which is used for striking a golf ball.

The back wall 210 of the cavity 205 can include a weight 240 disposed thereon, which can be positioned toward the sole portion 230 within the cavity 210. The weight 240 can have a specific length, which is less than or equal to the length of the cavity 205, and may extend along an axis projecting from the toe portion 215 to the heel portion 225. For example, in some embodiments, the length of the weight 240 can be approximately 60 millimeters. The weight 240 is generally positioned directly behind the ball-hitting portion of the face portion to provide a high coefficient of restitution (COR), which is typically greater than 0.8. This concentration of mass increases the sweet spot on the face portion, thereby improving the feel of the golf club for the average golfer. The weight 240 can adopt a variety of geometric shapes, including that of a rounded-triangle (as seen in FIG. 3), trapezoid, rectangle, rhombus, circle, or the like.

In some instances, it is desirable to have the thickness of the weight 240 be tapered along its length from the toe portion 215 to the heel portion 225, such that the weight 240 increases in thickness at it progresses from the heel portion 225 towards the toe portion 215. By way of example, the thickness of the tapered weight 240 can be approximately three (3) millimeters toward the toe portion 215, while it can be approximately one (1) to two (2) millimeters toward the heel portion 225. The taper allows more mass to be placed toward the toe portion 215 of the iron golf club head 200. This feature (i.e., the additional mass towards the toe portion 215) allows for off-center hits toward the toe of the face portion to feel more solid.

The back portion 210 of the iron golf club head 200 may also contain a y-shaped cavity pad 245, which extends between the top of the tapered weight 240 and the top of the cavity 205. The y-shaped cavity pad 245 may have a uniform thickness across its length, which is typically less than the thickness of the tapered weight 240. For example, the thickness of the y-shaped cavity pad 245 can be approximately one (1) millimeter. The y-shaped cavity pad 245 reinforces the upper portion of the cavity 205. The inclusion of the y-shaped cavity pad 245 provides an advantage over traditional cavity backed iron golf clubs. In traditional cavity-backed iron golf clubs, since the majority of the weight is moved toward the perimeter of the golf club, the cavity may resonate, or vibrate, especially on off-center hits, making the club feel unstable. The y-shaped cavity pad 245 of the present iron golf club head 200 provides a reinforcement of the upper portion of the cavity 205 and therefore, reduces unwanted vibrations within the cavity 105 producing a solid feel back to the golfer when striking a golf ball, especially on off-center hits. Furthermore, the y-shaped cavity pad 245 effectively extends and expands the sweet spot of the club head 200 out towards the toe portion 215 to provide increased forgiveness on off-center hits.

The iron golf club head 200 may also include an extended rear wall portion 235, which is offset from the back wall 210 of the cavity 205. The extended rear wall portion 235 also extends upward from the sole portion 230. The rearmost point of the extended rear wall portion 235 may be offset from the back wall 210 between approximately eight (8) and fifteen (15) millimeters. This allows more of the weight to be positioned farther back from the face portion and closer to the sole portion 230, which in turn increases the center of gravity (COG) depth of the golf club head 200.

Additionally, the extended rear wall portion 235 has a predefined thickness, which may be tapered along its length from the toe portion 215 to the sole portion 225. In one embodiment, the extended rear wall portion 235 has a thickness of approximately three to approximately six millimeters toward the toe portion 215, and a thickness of approximately two (2) to approximately four (4) millimeters toward the heel portion 225. The taper provides additional weight toward the toe portion 215 of the iron golf club 200 to provide further stability and promote a more solid feel to a golfer when the ball is struck off-center toward the toe of the face portion. The extended rear wall portion 235 has a height, which is tapered along its length from the toe portion 215 to the sole portion 225. In one embodiment, the extended rear wall portion 235 has a height of approximately 5 to approximately 25 millimeters, with the maximum height being toward the toe portion 215. The taper provides additional weight toward the toe portion 215 of the iron golf club 200 to provide further stability and promote a more solid feel to a golfer when the ball is struck off-center toward the toe of the face portion. Finally, the length of the extended rear wall portion 235 can range from approximately 40 millimeters to approximately 70 millimeters. The projected wall portion 235 is typically triangular in shape, with the base of rear wall portion 235 being the adjacent to the sole portion 230. Those skilled in the art will appreciate that the projected wall portion 235 may be in the form of other shapes, such as a trapezoid, a rectangle, a square, a circle, a semi-circle, and the like without departing from the scope of the invention.

Figure 4:
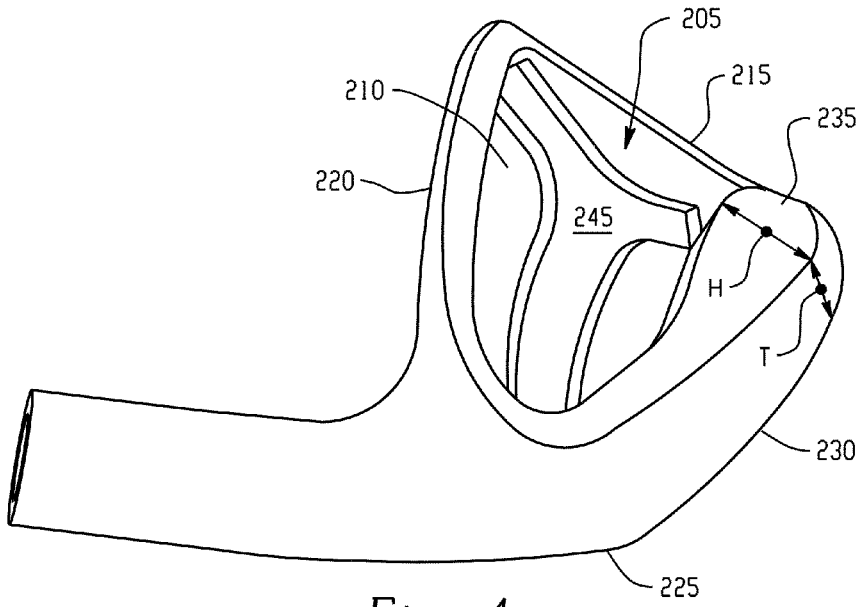
FIG. 4 is an illustration of a bottom perspective view of the iron golf club head of FIG. 2 in accordance with some embodiments of the present invention.

In an exemplary embodiment, shown in FIG. 4, the extended rear wall portion 235 has its maximum height, H, at a point that corresponds to the location where the sole portion 230 has its maximum thickness, T. That is, the peak point of the extended rear wall portion 235 is vertically aligned with the maximum thickness position of the sole portion 230. For example, the thickness of the sole portion 230 can by approximately 10 to approximately 25 millimeters at the heel portion 225, and approximately 15 to approximately 30 millimeters at T (where the height of the extended rear wall portion 235 is approximately 5 to approximately 25 millimeters). This feature provides an efficient COG depth, while keeping the overall weight of the extended rear wall portion 235 low. This feature also moves the COG away from the heel portion 225; and, in doing so, the moment of inertia (MOI) in the toe-heel direction is improved.

Referring again to FIG. 3, the iron golf club 200 may further contain a groove 250 running between the back wall 210 of the cavity 205 and the extended rear wall portion 235. The groove 250 extends in a direction from the toe portion 215 towards the heel portion 225 and may be set at an oblique angle relative to the back wall 245 of the cavity 205. The groove 250 may be positioned such that the end of the groove 250 toward the toe portion 215 is located farther away from the back wall 210 of the cavity than the end of the groove 250 located toward the heel portion 225. Typically, the groove 250 may be angled so that it is oriented parallel to the tapered weight 240 and the y-shaped cavity pad 245. By orienting the groove 250 parallel to the tapered weight 240 and the y-shaped cavity pad 245, more weight may be placed toward the toe portion 215 to further provide a solid feel on off-center hits that occur towards the toe portion 215 of face portion.

The groove 150 may have a width, W, in the range of approximately five (5) and twelve (12) millimeters. As the width of the groove 150 increases, more of the iron golf club's weight may be redistributed farther back from the cavity 105. Thus, as the more weight is moved backward away from the cavity 105, the center of gravity depth of the iron golf club 100 may be increased, which in turn may increase the effective loft of the iron golf club 100.

Figure 5:
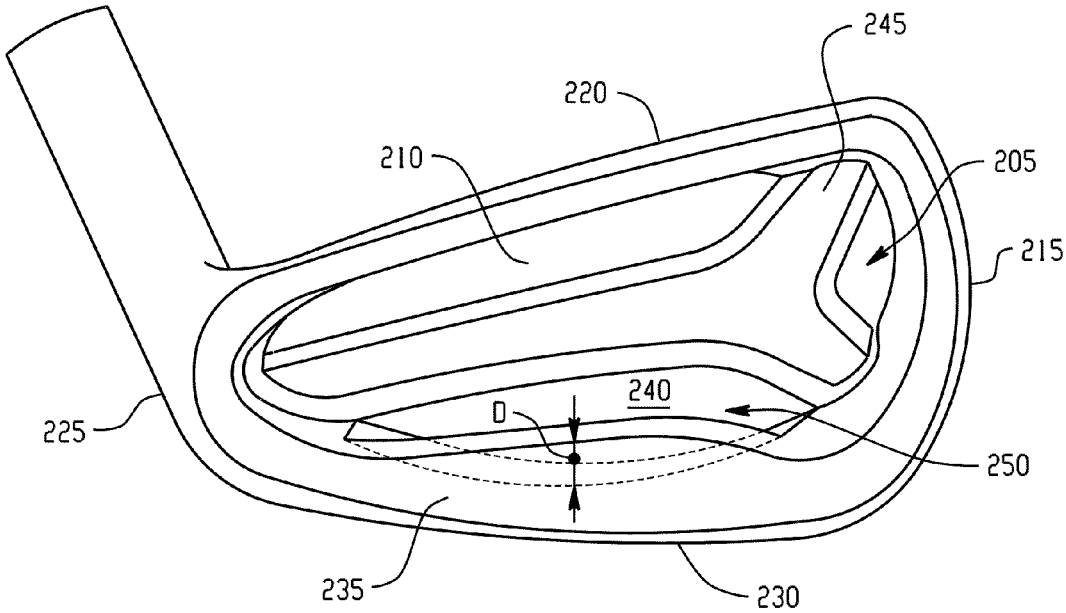
FIG. 5 is an illustration of the iron golf club of FIG. 3 viewed from the rear in accordance with some embodiments of the present invention.

The groove 250 also has a depth, D, as shown in FIG. 5. The depth, D of the groove 250 may change in the direction from the toe portion 215 to the heel portion 225. For example, as shown in FIG. 5, the groove 250 begins near the toe portion 215 and gradually increases in depth until it reaches the middle of the axis projecting from the toe portion 215 to the heel portion 225, and then gradually decreases in depth until it reaches the heel portion 225. Typically, the groove 250 will have a maximum depth in the range of approximately eight (8) to nine (9) millimeters. In one embodiment the maximum depth of the groove 250 may be 8.5 millimeters. The depth of the groove 250 will be largest for long iron golf club heads, intermediate for middle iron golf club heads, and smallest for short iron golf club heads. By providing the groove 250, as described above, the effective face length may be lengthened to make the face portion more flexible, thereby increasing the coefficient of restitution property of the face portion.

Figure 6:
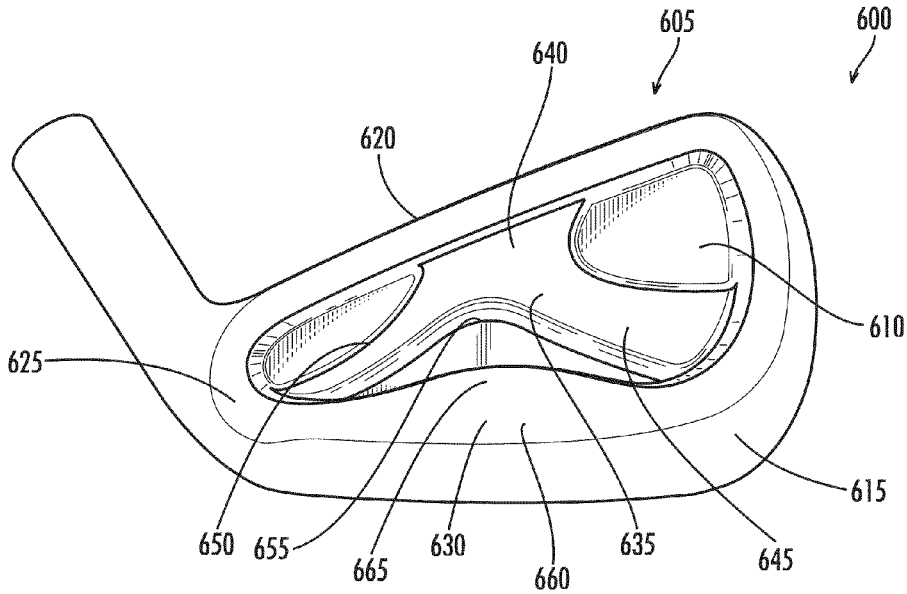
FIG. 6 is an illustration of another iron golf club embodiment in accordance with some embodiments of the present invention.
Figure 7:
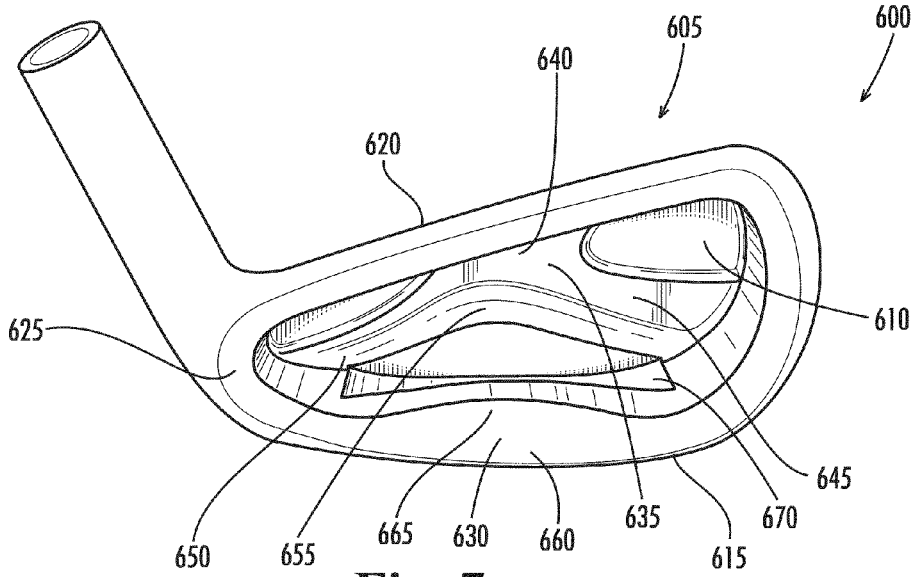
FIG. 7 is a rear perspective view of the iron golf club head of FIG. 6 in accordance with some embodiments of the present invention.
Figure 8:
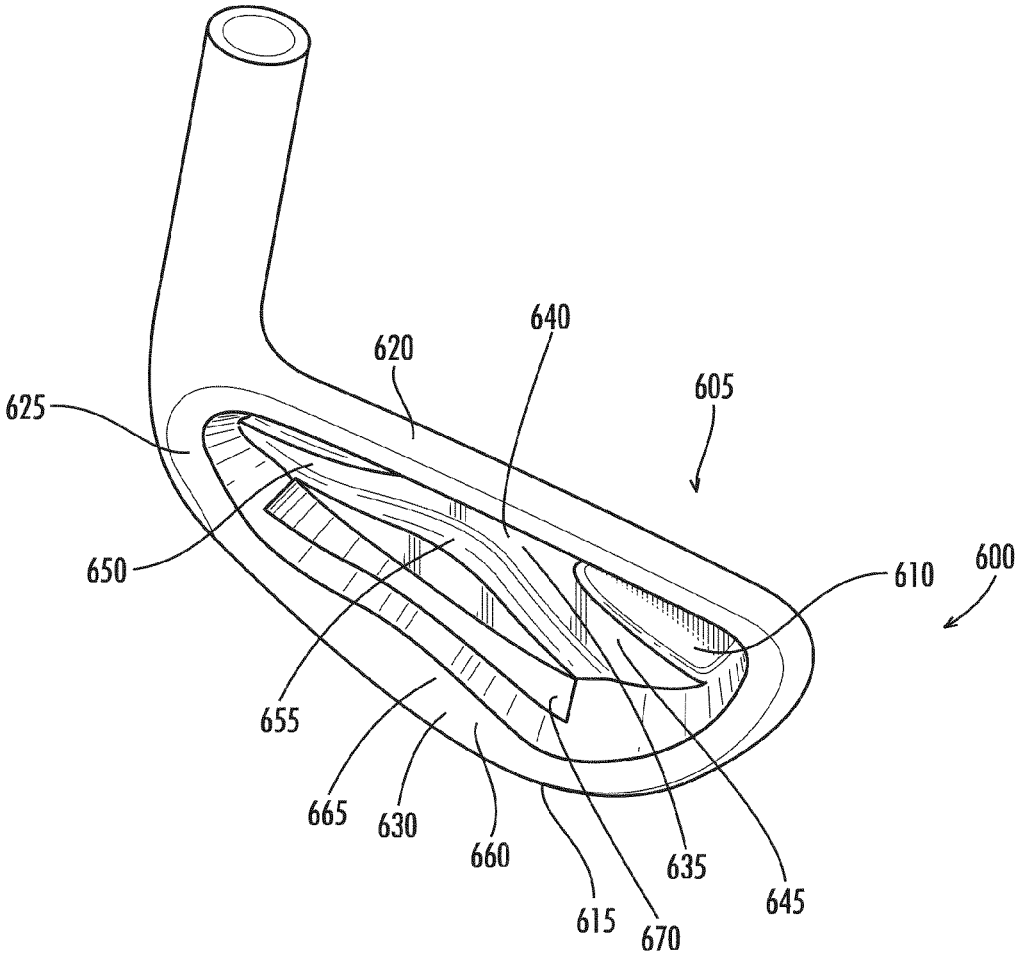
FIG. 8 is a top-angled perspective view of the iron golf club head of FIG. 6 in accordance with some embodiments of the present invention.

FIGS. 6-8 illustrate another iron golf club 600 embodiment in accordance with some embodiments of the present invention. The golf club 600 includes a cavity 605, which contains a back wall 610. The cavity is generally surrounded by a toe portion 615, a top portion 620, a heel portion 625, and a sole portion 630. The iron golf club head 600 also includes a face portion (not shown), which is used for striking a golf ball.

The golf club 600 may also include additional features, such as a y-shaped cavity pad 635. The y-shaped cavity pad can be disposed in an inverted fashion. In this arrangement, the base 640 of the y-shaped pad 635 can be positioned proximate the top portion 620 and the arms 645, 650 of the y-shaped cavity pad can extend in opposing directions away from the base toward the toe portion 615 and the heel portion 625. The y-shaped cavity pad 635 can be disposed, bonded, or forged into the cavity 605 and can extend out from the cavity 605.

In addition, the y-shaped cavity pad 635 can be configured as a cavity weight. The cavity weight can provide varied mass distribution to the golf club 600. As shown in FIGS. 6-8, the y-shaped cavity pad 635 can be configured so that the club's 600 center of gravity is shifted toward the club's shaft axis. Such a configuration can be accomplished by placing the apex 655 of the y-shaped cavity pad 635 at a central location of sole portion 630. In addition, such a configuration can be accomplished by placing the apex 655 of the y-shaped cavity pad closer to the heel portion 625 away from the toe portion 615.

The iron golf club head 600 may also include an extended rear wall portion 660. The extended rear wall portion 660 can be situated at an offset position from the back wall 610 of the cavity 605. A groove 670 (e.g., a semicircular groove) can be disposed between the back wall 610 and the extended rear wall portion 660. The extended rear wall portion 660 also extends upward from the sole portion 630. The rearmost point of the extended rear wall portion 235 may be offset from the back wall 210 between approximately eight (8) and fifteen (15) millimeters. This enables more of the weight to be positioned farther back from the face portion and closer to the sole portion 630, which in turn increases the center of gravity depth of the golf club head 600. In addition, the extended rear wall portion 660 can have an apex 665 that corresponds to the apex 655 of the y-shaped cavity pad 635. Such an advantageous arrangement enables placement of the club's center of gravity closer to the club's shaft axis.

The iron golf club heads 100, 200, 600 described above, may be used to create a golf club set, which includes at least one long iron golf club (e.g., No. 1 through No. 5 iron golf clubs), at least one middle iron golf club (e.g., No. 6 and No. 7 iron golf club heads), and at least one short iron golf club (e.g., No. 8, No. 9, a pitching wedge, sand wedge, gap wedge, lob wedge or like iron golf club heads). Each of the at least one long iron golf clubs, the middle iron golf clubs and the short iron golf clubs can include a golf club head 100, 200, 600 that includes a cavity 105, 205, 605, which contains a back wall 110, 210, 610 and is surrounded by a toe portion 115, 215, 615 a top portion 120, 220, 620, a heel portion 125, 225, 625, and a sole portion 130, 230, 630. The heads 100, 200, 600 of these golf clubs also include a face portion (not shown), which is used for striking a golf ball. Each of the heads 100, 200, 600 of the at least one long iron golf club, middle iron golf club, and short iron golf club can also include a y-shaped cavity 145, 245, 630 disposed on the back wall 110, 210, 610 of the cavity 105, 205, 605.

Each of the heads 100, 200, 600 of the at least one long iron golf club, middle iron golf club, and short iron golf club can also include an extended rear wall portion 135, 235, 660 which is offset from the back wall 110, 210, 610 of the cavity 105, 205, 605. The extended rear wall portion 135, 235, 660 can also extend upward from the sole portion 130, 230, 630. Further, each of the heads 100, 200, 600 of the at least one long iron golf club, middle iron golf club, and short iron golf club can also have a weight 140, 240, 635 generally positioned directly behind the ball-hitting portion of the face portion.

In those sets that make use of iron golf club head 200 for the at least one long iron golf club, middle iron golf club, and short iron golf club, the at least one long iron golf club, middle iron golf club, and short iron golf club can also have a groove 250 disposed between the extended rear wall portion 235 and the back wall 210 of the cavity 205. In some cases, the optional weight 240 can be placed on at least a portion of the back wall 210 of the cavity 205 where the groove 250 is positioned. The width and/or depth of the groove 250 may vary between the long iron golf clubs, the middle iron golf clubs, and the short iron golf clubs. For example, the width and/or depth of the groove 250 may decrease from the long irons to the middle irons, and from the middle irons to the short irons within the golf club set. In exemplary embodiments, only the heads 200 of the at least one long iron golf club and at least one middle iron golf club have a groove 250.

The embodiments of the present invention are not limited to the particular dimensions and materials disclosed herein as such dimensions and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

We claim:

1. An iron golf club head having a cavity, a face portion, a heel portion, a toe portion, a top portion and a sole portion, the iron golf club head, comprising:

at least a y-shaped cavity pad disposed on at least a portion of a back wall of the cavity, an extended rear wall extending upward from the sole portion, wherein the extended rear wall is triangular in shape, wherein a location of a maximum height of the triangular extended rear wall is vertically aligned with a location of a maximum thickness of the sole portion, and a weight disposed on at least a portion of the back wall of the cavity and extending upward from the sole portion, wherein the y-shaped cavity pad extends between the top of the weight and a top of the cavity.

2. An iron-type golf club comprising:

a cavity portion situated on an opposing side of a face portion of the golf club;

a cavity pad having a y-shape positioned on the cavity portion with ends of the y-shaped cavity pad extending away from a central point of the y-shaped cavity pad;

a rear wall having a varied height spaced apart from the cavity and the y-shaped cavity pad; and a sole portion having a varied thickness with a location of maximum thickness, and wherein the location of maximum thickness of the sole is vertically aligned with a location of a maximum height of the rear wall.

3. The iron-type golf club of claim 2, wherein the y-shaped cavity pad is disposed in an inverted fashion having a base arm situated proximate a top portion of the club, a first extension arm situated proximate a heel portion of the club, and a second extension arm situated proximate a toe portion of the club.

4. The iron-type golf club of claim 2, wherein the y-shaped cavity pad has an apex portion located proximate a central location of the cavity, wherein the apex portion is a junction of the extensions of the y- shaped cavity pad.

5. The iron-type golf club of claim 2, wherein the rear wall has a varied shape with an apex portion located proximate a central location of the cavity.

6. The iron-type golf club of claim 2, further comprising a groove portion generally disposed between the rear wall portion and the cavity, the groove having a location of maximum depth aligned with an apex portion of the y-shaped cavity pad, wherein the apex portion is a junction of the extensions of the y-shaped cavity pad.

* * * * *